US007599638B2

(12) United States Patent
Nakano

(10) Patent No.: US 7,599,638 B2
(45) Date of Patent: Oct. 6, 2009

(54) IMAGE FORMING APPARATUS HAVING HIGH VOLTAGE POWER SUPPLIES

(75) Inventor: Hiroshi Nakano, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 346 days.

(21) Appl. No.: 11/563,877

(22) Filed: Nov. 28, 2006

(65) Prior Publication Data

US 2007/0147872 A1 Jun. 28, 2007

(30) Foreign Application Priority Data

Dec. 26, 2005 (JP) ..... 2005-371967

(51) Int. Cl.
*G03G 15/00* (2006.01)

(52) U.S. Cl. ..... 399/88; 399/89

(58) Field of Classification Search ..... 399/88, 399/89, 168, 314

See application file for complete search history.

(56) References Cited

U.S. PATENT DOCUMENTS 5,923,939 A * 7/1999 Koyama ..... 399/308

FOREIGN PATENT DOCUMENTS

| | | |
|---|---|---|
| JP | 2004240403 | 8/2004 |
| JP | 2005309278 | 11/2005 |

* cited by examiner

*Primary Examiner*—Hoang Ngo
(74) *Attorney, Agent, or Firm*—Banner & Witcoff, Ltd.

(57) ABSTRACT

An image forming apparatus comprising an image bearing member, a transfer mechanism that transfers a developer image formed on the image bearing member, a charger that charges the image bearing member, a first high voltage power supply substrate that applies a first voltage to the transfer mechanism, and a second high voltage power supply substrate that applies a second voltage to the charger, wherein the second voltage has a polarity opposite to the first voltage.

20 Claims, 3 Drawing Sheets

IMAGE FORMING APPARATUS HAVING HIGH VOLTAGE POWER SUPPLIES

CROSS REFERENCE TO RELATED APPLICATION

This application claims priority from Japanese Patent Application No. 2005-371967 filed Dec. 25, 2005. The entire content of this priority application is incorporated herein by reference.

TECHNICAL FIELD

The present invention relates to an electrophotographic image forming apparatus such as a laser printer.

BACKGROUND

An image forming apparatus for electrophotographic image formation includes various power supply members to which high voltage power is supplied, such as a transfer roller, a charger, or a developing roller. To these power supplied members, power is supplied from one high voltage power supply substrate provided in an apparatus body of the image forming apparatus.

On the high voltage power supply substrate, a plurality of electrodes electrically connected to the power supplied members are provided, and the electrodes are placed at certain intervals for preventing discharge. Particularly, high voltages are applied to the transfer roller and the charger, the voltages have opposite polarities, and thus the transfer roller and the charger have a large potential difference, which requires large intervals between the electrodes connected to the transfer roller and the charger.

SUMMARY

Specifically, an interval of 2 mm per a potential difference of 1 kV is required between a pair of electrodes, and when the voltage of the transfer roller is −8 kV and the voltage of the charger is +8 kV, the potential difference therebetween is 16 kV, which requires an interval of 32 mm between the electrodes connected to the transfer roller and the charger. Thus, reduction in size of a substrate has been limited in terms of the need for ensuring an interval between electrodes that have a large potential difference, thereby preventing reduction in size of the entire image forming apparatus. Also, wires connected to the high voltage power supply substrate and having a larger potential difference have required to be placed with a larger distance, which limits layout in the apparatus, thereby preventing reduction in size of the image forming apparatus.

An image forming apparatus comprising an image bearing member, a transfer mechanism that transfers a developer image formed on the image bearing member, a charger that charges the image bearing member, a first high voltage power supply substrate that applies a first voltage to the transfer mechanism, and a second high voltage power supply substrate that applies a second voltage to the charger, wherein the second voltage has a polarity opposite to the first voltage.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

Now, one aspect of the present invention will be described with reference to FIGS. 1 and 2.

Figure 1:
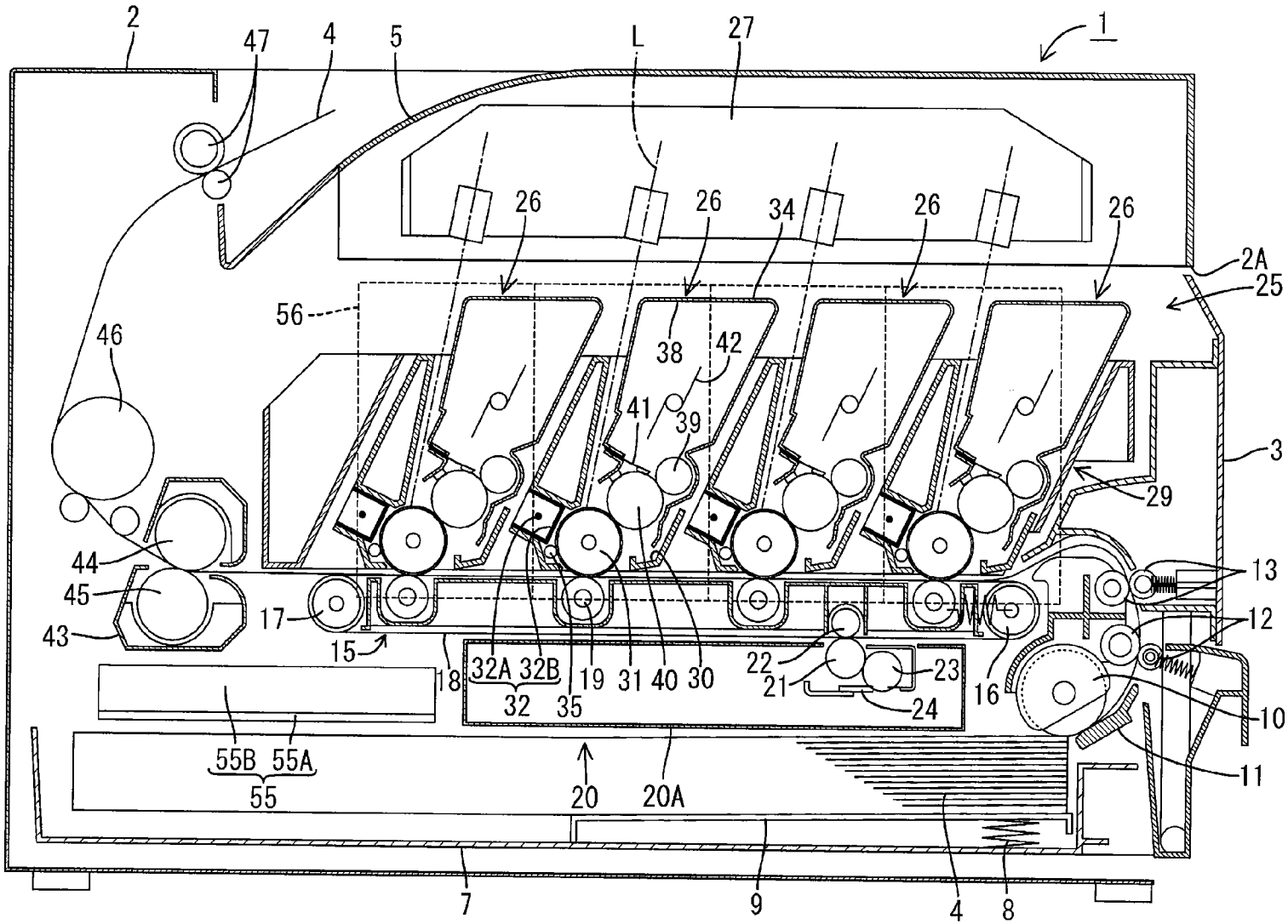
FIG. 1 is a side sectional view of a schematic configuration of an image forming apparatus according to one aspect of the present invention.

FIG. 1 is a side sectional view of a schematic configuration of image forming apparatus 1 according to one aspect of the present invention. In the description below, the right side in FIG. 1 shows the front.

The image forming apparatus 1 can be a laser printer, or more specifically can be a direct transfer tandem type color laser printer. Image forming apparatus 1 includes a substantially box-shaped body casing 2 as shown in FIG. 1, and an attachment and detachment opening 2A, which can be covered with an openable and closable front cover 3. The front cover 3 can be opened to allow a process portion 25 to be moved forward from the body casing 2. An output tray 5 that receives recorded medium 4 after image formation can be formed on an upper surface of the body casing 2. Recording medium 4 can include, but is not limited to, paper and the like.

A feed tray 7 that receives recording medium 4 for image formation is mounted to a lower portion of the body casing 2 so as to be movable forward. A pressure plate 9 tiltable to raise a front end of the recording medium 4, by urging a spring 8, is provided in the feed tray 7. Above a front end of the feed tray 7, a pickup roller 10 and a separation pad 11 that abuts against the pickup roller 10 by urging a spring (not shown) are provided. Further, a pair of feed rollers 12 are provided obliquely upward on the front of the pickup roller 10, and a pair of registration rollers 13 are provided above the feed rollers 12.

In the uppermost position of the feed tray 7, recording medium 4 is pressed toward the pickup roller 10 by the pressure plate 9, and is separated (one by one when there is a plurality) when held between the pickup roller 10 and the separation pad 11 by rotation of the pickup roller 10. The recording medium 4 fed from between the pickup roller 10 and the separation pad 11 is fed to the registration rollers 13 by the feed rollers 12. The registration rollers 13 feed the recording medium 4 onto a belt unit 15 at a predetermined time.

The belt unit 15 is detachably attached to the body casing 2, and has a conveying belt 18 horizontally extended between a pair of belt support rollers 16 and 17 spaced apart at the front and the rear. The conveying belt 18 can be a belt made of resin material such as polycarbonate adapted to function as a transfer belt, and circulatingly moved counterclockwise (in FIG. 1) by rotatably driving the belt support roller 17 to convey recording medium 4 thereon. Inside the conveying belt 18, transfer rollers 19 are positioned to face photosensitive drums 31 of image forming units 26 (which will be described later). The transfer rollers 19 are provided in line at regular intervals in a direction from the front to the back, and the conveying belt 18 is held between the photosensitive drums 31 and the corresponding transfer rollers 19. Each transfer roller 19 can be formed by covering a metal roller shaft with an elastic member such as conductive rubber. In transfer, a transfer bias having a negative polarity (for example, −8 kV) can be applied to the transfer rollers 19 by a bias applying circuit (which will be described later).

A belt cleaner 20 for removing toner or paper powder adhering to the conveying belt 18 can be provided in a lower side of the belt unit 15. The belt cleaner 20 can include a flat box-shaped case 20A and a cleaning roller 21 therein. The cleaning roller 21, which can be formed by providing foamed material of silicon around a metal shaft member, faces a metal backup roller 22 provided in the belt unit 15 via the conveying belt 18. At least during cleaning, an urging force toward the conveying belt 18 is applied to the backup roller 22, and the conveying belt 18 is held between the backup roller 22 and the cleaning roller 21 by an appropriate pressure. A metal collecting roller 23 abuts against the cleaning roller 21, and a tip of a blade 24 abuts against the collecting roller 23. A bias voltage having a negative polarity (for example, −3 kV) can be applied between the cleaning roller 21 and the grounded backup roller 22 by a bias applying circuit (which will be described later), and thus the toner or the paper powder adhering on the conveying belt 18 is removed by the cleaning roller 21 and electrically sucked toward the cleaning roller 21. A bias voltage (for example, −3.5 kV) having a negative polarity and higher than the voltage applied to the cleaning roller 21 can be applied to the collecting roller 23 by the bias applying circuit, and thus the toner or the like adhering on the cleaning roller 21 is electrically sucked toward the collecting roller 23. The toner or the like adhering on the collecting roller 23 is removed by the blade 24 and stored in the case 20A.

A scanner unit 27 is provided in an upper portion in the body casing 2, the process portion 25 is provided below the scanner unit 27, and the belt unit 15 is placed below the process portion 25.

The scanner unit 27 emits a laser light L of multiple colors based on predetermined image data, onto a surface of a corresponding photosensitive drum 31 by high speed scanning.

The process portion 25 can include image forming units 26 corresponding to multiple colors (of, for example, magenta, yellow, cyan and black), and the image forming unit (s) 26 are placed in line in the direction from the front to the back. Each image forming unit 26 includes the photosensitive drum 31, a charger 32 (i.e. a scorotron type), a developing cartridge 34, and a cleaning roller 35. The process portion 25 includes a process frame 29 having cartridge mounting portions 30 arranged in line in the direction from the front to the back. The developing cartridge 34 is mounted to each cartridge mounting portion 30 so that each developing cartridge 34 is detachably attached to the cartridge mounting portion 30 with the process frame 29 moveable forward from the attachment and detachment opening 2A. In the process frame 29, the photosensitive drum 31 of each image forming unit 26 is held in a lower end position of each cartridge mounting portion 30, and the charger 32 is held adjacent to the photosensitive drum 31.

The photosensitive drum 31 can include a grounded metal drum body, and formed by covering a surface of the drum body with a positively charged photosensitive layer such as of polycarbonate.

The charger 32 includes a discharge wire 32A placed to face the photosensitive drum 31 with a predetermined space, and a grid 32B provided between the discharge wire 32A and the photosensitive drum 31, for controlling the amount of discharge from the discharge wire 32A to the photosensitive drum 31. In the charger 32, the bias applying circuit applies a bias voltage having a positive polarity (for example, +700 to 800 V) to the grid 32B and applies a bias voltage having a positive polarity (for example, +8 kV) to the discharge wire 32A to generate corona discharge from the discharge wire 32A, thereby positively charging the surface of the photosensitive drum 31 uniformly.

The developing cartridge 34 includes a toner accommodating chamber 38 in an upper portion therein, a supply roller 39, a developing roller 40 and a layer thickness control blade 41. Each toner accommodating chamber 38 accommodates toner of one nonmagnetic component positively charged plurality of colors (i.e. yellow, magenta, cyan and black) as a developer. Each toner accommodating chamber 38 includes an agitator 42 for agitating the toner.

The supply roller 39 can be formed by covering a metal roller shaft with conductive foam material. The developing roller 40 can be formed by covering a metal roller shaft with conductive rubber material, and a bias voltage having a positive polarity (for example, +500 to 600 V) is applied to the developing roller 40 by the bias applying circuit in development. The toner discharged from the toner accommodating chamber 38 is supplied to the developing roller 40 by rotation of the supply roller 39, and is frictionally charged positively between the supply roller 39 and the developing roller 40. Further, the toner supplied onto the developing roller 40 enters between the layer thickness control blade 41 and the developing roller 40 with rotation of the developing roller 40, and is further frictionally charged and carried on the developing roller 40 as a thin layer having a certain thickness.

The surface of the photosensitive drum 31 is positively charged uniformly by the charger 32 during rotation of the photosensitive drum 31. Then, the surface is exposed to light by the high speed scanning of the laser light L from the scanner portion 27 to form an electrostatic latent image corresponding to an image to be formed on the recording medium 4.

Then, by the rotation of the developing roller 40, the toner carried on the developing roller 40 and positively charged is supplied to the electrostatic latent image formed on the surface of the photosensitive drum 31. Thus, the electrostatic latent image on the photosensitive drum 31 is visualized, and the surface of the photosensitive drum 31 carries a toner image with the toner adhering to exposed portions only.

Then, toner images carried on the surfaces of the photosensitive drums 31 are successively transferred to recording medium 4 by a transfer bias having a negative polarity applied to the transfer rollers 19 while the recording medium 4, conveyed by the conveying belt 18, passes each transfer position between the photosensitive drums 31 and the transfer rollers 19. Thus, the recording medium 4, with the toner images transferred, is then conveyed to a fixing device 43.

The cleaning roller 35 can be made of a conductive member and placed so that a tip thereof comes into contact with the photosensitive drum 31. In image formation, a bias voltage having a negative polarity (for example, −200 V) can be applied to the cleaning roller 35 by the bias applying circuit, and thus the cleaning roller 35 electrically attracts residual toner adhering on the photosensitive drum 31. In toner collection, a bias voltage having a positive polarity (for example, +800 V) can be applied to the cleaning roller 35 by the bias applying circuit, and thus the toner adhering on the cleaning roller 35 is transferred onto the photosensitive drum 31. The toner, transferred onto the photosensitive drum 31, is further transferred to the developing roller 40 to which a developing bias voltage is applied, and collected.

The fixing device 43 is placed on the rear of the conveying belt 18 in the body casing 2. The fixing device 43 includes a heating roller 44 having a heat source such as a halogen lamp which is rotatably driven. Fixing device 43 also includes a press roller 45 placed below the heating roller 44 to face the heating roller 44 so as to press the heating roller 44. In the fixing device 43, the recording medium 4 carrying the toner image with the plurality of colors is heated while being held between the heating roller 44 and the press roller 45 and conveyed to fix the toner image on the recording medium 4. The recording medium 4 subjected to the heat fixing is conveyed to a paper output roller 47 provided in an upper portion of the body casing 2 by a conveying roller 46 placed obliquely upward on the rear of the fixing device 43, and output onto the paper output tray 5 by the paper output roller 47.

Next, a pair of high voltage power supply substrates 55 and 56 including bias applying circuits are provided for supplying high voltage power to parts such as the transfer rollers 19 and the charger 32. FIG. 2 is a front sectional view of the schematic configuration of the image forming apparatus 1.

Figure 2:
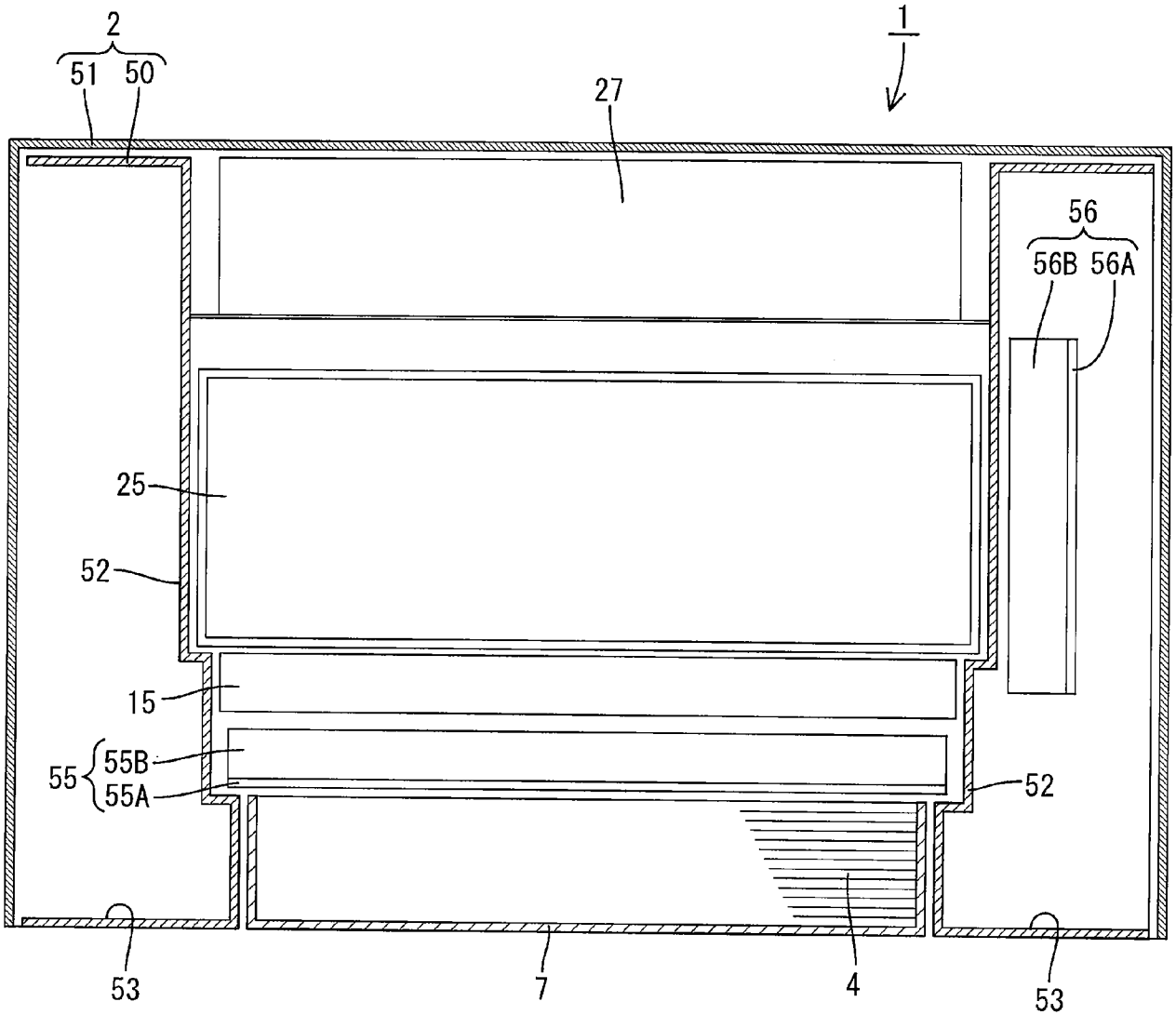
FIG. 2 is a front sectional view of the schematic configuration of the image forming apparatus similar to FIG. 1.

As shown in FIG. 2, the body casing 2 is constituted by a body frame 50 that is a framework, and a resin outer cover 51 covering an outer surface of the body frame 50. The body frame 50 includes a pair of right and left side walls 52 (made of, for example, insulating synthetic resin material), and each side wall 52 has a peripheral edge extended outward to form an accommodating recess 53. In the accommodating recess 53, for example, a gear mechanism for transferring power from a main motor to each part and a control circuit board for controlling operation of each part, or the like are provided, though not shown in detail.

In the body casing 2, two-divided bias applying circuits for applying a high voltage to each part are provided on two substrates: the first high voltage power supply substrate 55 and the second high voltage power supply substrate 56. The first high-voltage power supply substrate 55 can be placed below the belt unit 15 and the fixing device 43, and placed horizontally to face a lower surface of the belt 18 in parallel. In the drawings, reference numeral 55A denotes a substrate body, and reference numeral 55B denotes a space in which a mounting component thereof is placed. On the first high voltage power supply substrate 55, a bias applying circuit (not shown) that applies a bias voltage to each transfer roller 19 and the belt cleaner 20 (the cleaning roller 21 and the collecting roller 23), and electrodes (not shown) for electrically connecting the bias applying circuit and each transfer roller 19 or the like are provided. The first high voltage power supply substrate 55 independently applies a bias voltage to each transfer roller 19.

The second high voltage power supply substrate 56 can be vertically placed in the right accommodating recess 53 when seen from the front of the body casing 2. Specifically, the first high voltage power supply substrate 55 is placed inside the body frame 50, while the second high voltage power supply substrate 56 is placed outside the body frame 50, and the side walls 52 of insulating synthetic resin material are provided between the high voltage power supply substrates 55 and 56. In FIG. 2, reference numeral 56A denotes a substrate body of the second high voltage power supply substrate 56, and reference numeral 56B denotes a space in which a mounting component thereof is placed. As shown by broken lines in FIG. 1, the second high voltage power supply substrate 56 can be divided into four areas in a direction from the front to the back, and in each area, a bias applying circuit (not shown) for applying a bias voltage to the developing roller 40, the charger 32 (the charging wire 32A and the grid 32B), cleaning roller 35 (included in the corresponding image forming unit 26), and electrodes (not shown) for electrically connecting the bias applying circuit and the developing roller 40 or the like are provided.

As described above, according to the aspect, the two-divided high voltage power supply substrates are provided that supply power to the transfer roller 19 and the charger 32 having a particularly large potential difference, thereby allowing reduction in potential difference between the electrodes placed on the substrates 55 and 56 and reduction in size of the substrates 55 and 56. The two-divided high voltage power supply substrates 55 and 56 are provided to increase flexibility in layout in the apparatus. This allows reduction in size of the image forming apparatus 1.

The body frame 50 is placed between the high voltage power supply substrates 55 and 56, and thus the substrates 55 and 56 can be placed close to each other while being insulated, thereby allowing reduction in size of the image forming apparatus 1.

The first high voltage power supply substrate 55 that supplies power to the transfer rollers 19 of the belt unit 15 is placed to face the belt 18 in parallel, thereby increasing space efficiency.

The substrate that supplies power to the belt cleaner 20 is common with the first high voltage power supply substrate 55 that supplies power to the transfer rollers 19 of the belt unit 15, thereby allowing the substrate to be placed close to the belt cleaner 20. This allows an electrode for supplying power to the belt cleaner 20 to be easily placed. Also, the high space efficiency allows reduction in size of the image forming apparatus 1.

The substrate that supplies power having the same polarity as the charger 32 to the developing roller 40 is common with the second high voltage power supply substrate 56 that supplies power to the charger 32, and thus potential differences between the electrodes on the substrates 55 and 56 are reduced as compared with the case where the first high voltage power supply substrate 55 that supplies power to the transfer rollers 19, having an opposite polarity, supplies power to the developing roller 40. Thus, reduction in size of the substrates 55 and 56 can be realized.

Next, another aspect of the present invention will be described with reference to FIG. 3.

Figure 3:
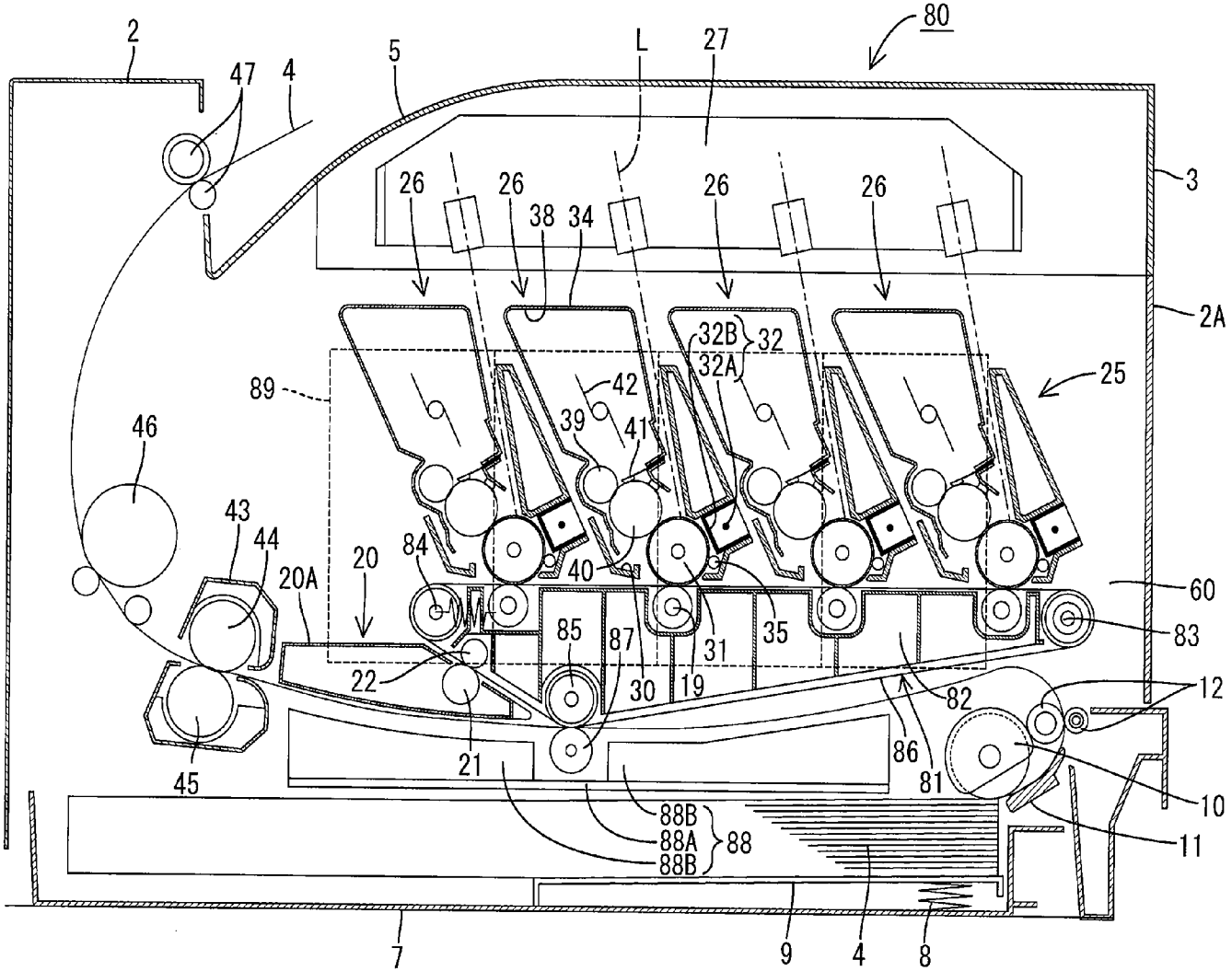
FIG. 3 is a side sectional view of a schematic configuration of an image forming apparatus according to another aspect of the present invention.

FIG. 3 is a side sectional view of a schematic configuration of image forming apparatus 80 according to one aspect of the present invention. In the description below, the right side in FIG. 3 shows the front.

The image forming apparatus 80 of according to this aspect of the present invention can be a laser printer, or more specifically can be an intermediate transfer tandem type color laser printer using an intermediate transfer belt 86. Components having substantially the same functions as in the above described aspect will be denoted by the same reference numerals, and descriptions thereof will be omitted.

The image forming apparatus 80 includes a belt unit 81 detachably attached to a body casing 2. The belt unit 81 has a belt frame 82 (made of, for example, insulating synthetic resin material) having a substantially triangular shape when seen from the side. Belt support rollers 83, 84 and 85 are provided at a front end, a rear end, and a lower end, respectively, of the belt frame 82, and the intermediate transfer belt 86 is extended by the belt support rollers 83, 84 and 85. Transfer rollers 19 are placed on an upper surface of the belt frame 82, and face photosensitive drums 31 of image forming units 26 via the intermediate transfer belt 86.

A secondary transfer roller 87 that faces the belt support roller 85 at the lower end of the belt frame 82 via the intermediate transfer belt 86 is provided below the belt unit 81. A secondary transfer bias having a negative polarity can be applied between the secondary transfer roller 87 and the grounded belt support roller 85 by a bias applying circuit. A belt cleaner 20 that cleans the intermediate transfer belt 86 is placed on the rear of the belt unit 81. In the image forming apparatus 80, toner images formed on the four photosensitive drums 31, for a plurality of colors, are transferred to the intermediate transfer belt 86, then the toner images transferred to the intermediate transfer belt 86 are transferred onto recording medium 4 when the recording medium 4 passes a contact position between the secondary transfer roller 87 and the intermediate transfer belt 86.

Also in the image forming apparatus 80, two-divided bias applying circuits for applying a high voltage to each part are provided on two substrates: a first high voltage power supply substrate 88 and a second high voltage power supply substrate 89. The first high voltage power supply substrate 88 is horizontally placed immediately below the belt unit 81 and the belt cleaner 20. In FIG. 3, reference numeral 88A denotes a substrate body, and reference numeral 88B denotes a space in which a mounting component thereof is placed. On the first high voltage power supply substrate 88, a bias applying circuit that can apply a bias voltage to each transfer roller 19, the secondary transfer roller 87, the belt cleaner 20 (a cleaning roller 21 and a collecting roller 23), and electrodes for electrically connecting the bias applying circuit and each transfer roller 19 or the like are provided.

Like the second high voltage power supply substrate 56 in the above described aspect, the second high voltage power supply substrate 89 is vertically placed in an accommodating recess 53 of the body casing 2. As shown by broken lines in FIG. 3, the second high voltage power supply substrate 89 can be divided into four areas in a direction from the front to the back, and in each area, a bias applying circuit for applying a bias voltage to a developing roller 40, a charger 32 (a charging wire 32A and a grid 32B), a cleaning roller 35 (included in a corresponding image forming unit 26), and electrodes for electrically connecting the bias applying circuit and the developing roller 40 or the like are provided.

According to this aspect, the two-divided high voltage power supply substrates 88 and 89 are provided that supply power to the transfer roller 19 and the secondary transfer roller 87, and the charger 32, having a large potential difference, thereby allowing reduction in potential difference between the electrodes placed on the substrates 88 and 89 and reduction in size of the substrates 88 and 89. The two-divided high voltage power supply substrates 88 and 89 are provided to increase flexibility in layout in the apparatus. This allows reduction in size of the image forming apparatus 80.

In each of the aspects, the present invention can be applied to the color image forming apparatus including plural sets of transfer mechanisms and chargers, but the present invention can be applied to a black and white image forming apparatus having one set of transfer mechanism and charger.

In each of the aspects, the synthetic resin body frame is placed between the first and second high voltage power supply substrates, but according to the present invention, a metal body frame may be placed between the substrates, and an insulating sheet may be placed between the metal body frame and each substrate.

What is claimed is:

1. An image forming apparatus comprising:

an image bearing member;

a transfer mechanism that transfers a developer image formed on said image bearing member;

a charger that charges said image bearing member;

a first high voltage power supply substrate that applies a first voltage to said transfer mechanism;

a second high voltage power supply substrate that applies a second voltage to said charger, wherein the second voltage has a polarity opposite to the first voltage; and a body frame that separates said first high voltage power supply substrate from said second high voltage power supply substrate.

2. The image forming apparatus according to claim 1, wherein said body frame is made of insulating material.

3. The image forming apparatus according to claim 1, wherein said apparatus further comprises a belt unit having a belt with a belt surface, said transfer mechanism is positioned inside said belt, and said first high voltage power supply substrate is positioned to face said belt surface.

4. The image forming apparatus according to claim 1, wherein said apparatus further comprises:

a belt unit having a belt with a belt surface, said transfer mechanism being placed inside said belt; and a belt cleaner that cleans said belt, and said first high voltage power supply substrate applies the first voltage to said belt cleaner.

5. The image forming apparatus according to claim 1, wherein said transfer mechanism includes a plurality of transfer mechanisms and said first high voltage power supply substrate independently applies a first voltage to each in the plurality of transfer mechanisms, further wherein said charger includes a plurality of chargers and said second high voltage power supply substrate independently applies the second voltage to each of said chargers.

6. The image forming apparatus according to claim 1, wherein said apparatus further comprises a developing mechanism that develops an electrostatic latent image formed on said image bearing member, and said second high voltage power supply substrate applies the second voltage to said developing mechanism.

7. The image forming apparatus according to claim 2, wherein said insulating material is made of synthetic resin.

8. An image forming apparatus comprising:

an image bearing member;

a transfer mechanism that transfers a developer image formed on said image bearing member;

a developing mechanism that develops an electrostatic latent image formed on said image bearing member;

a first high voltage power supply substrate that is structured to provide a first voltage to said transfer mechanism;

a second high voltage power supply substrate that is structured to provide a second voltage having a polarity opposite to said first voltage to said developing mechanism; and a body frame that separates said first high voltage power supply substrate from said second high voltage power supply substrate.

9. The image forming apparatus according to claim 8, wherein said body frame is made of insulating material.

10. The image forming apparatus according to claim 9, wherein said insulating material is made of synthetic resin.

11. The image forming apparatus according to claim 8, wherein said apparatus further comprises a belt unit having a belt with a belt surface, said transfer mechanism positioned inside said belt, and said first high voltage power supply substrate is positioned to face said belt surface.

12. The image forming apparatus according to claim 8, wherein said apparatus further comprises:

a belt unit having a belt with a belt surface, said transfer mechanism positioned inside said belt; and a belt cleaner that cleans said belt, wherein said first high voltage power supply substrate is structured to provide the first voltage to said belt cleaner.

13. The image forming apparatus according to claim 8, wherein said transfer mechanism includes a plurality of transfer mechanisms and said first high voltage power supply substrate independently applies a first voltage to each in the plurality of transfer mechanisms, further wherein said developing mechanism includes a plurality of developing mechanisms and said second high voltage power supply substrate independently applies the second voltage to each of said developing mechanisms.

14. An image forming apparatus comprising:

an image bearing member;

a charger that charges said image bearing member;

a belt unit having a belt with a belt surface;

a first transfer mechanism that is positioned inside said belt, and transfers a developer image formed on said image bearing member onto said belt surface;

a second transfer mechanism that transfers the developer image on said belt surface onto a recording medium;

a first high voltage power supply substrate that provides a first voltage to said first transfer mechanism and said second transfer mechanism;

a second high voltage power supply substrate that provides a second voltage having a polarity opposite to said first voltage to said charger; and a body frame that separates said first high voltage power supply substrate from said second high voltage power supply substrate.

15. The image forming apparatus according to claim 14, wherein said body frame is made of insulating material.

16. The image forming apparatus according to claim 14, wherein said first high voltage power supply substrate is positioned to face said belt surface.

17. The image forming apparatus according to claim 14, wherein said apparatus further comprises a belt cleaner that cleans said belt, and said first high voltage power supply substrate applies the first voltage.

18. The image forming apparatus according to claim 14, wherein said transfer mechanism includes a plurality of transfer mechanisms and said first high voltage power supply substrate independently applies a first voltage to each in the plurality of transfer mechanisms, further wherein said charger includes a plurality of chargers and said second high voltage power supply substrate independently applies the second voltage to each of said chargers.

19. The image forming apparatus according to claim 14, wherein said apparatus further comprises a developing mechanism that develops an electrostatic latent image formed on said image bearing member, and said second high voltage power supply substrate applies the second voltage to said developing mechanism.

20. The image forming apparatus according to claim 15, wherein said insulating material is made of synthetic resin.

* * * * *